US009571941B2

(12) United States Patent
Heidenreich et al.

(10) Patent No.: US 9,571,941 B2
(45) Date of Patent: Feb. 14, 2017

(54) DYNAMIC DRIVER IN HEARING INSTRUMENT

(71) Applicant: Knowles Electronics, LLC, Itasca, IL (US)

(72) Inventors: Joseph Heidenreich, Lake Zurich, IL (US); Evan Llamas-Young, Morgan Hill, CA (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 14/454,281

(22) Filed: Aug. 7, 2014

(65) Prior Publication Data

US 2015/0049893 A1 Feb. 19, 2015

Related U.S. Application Data

(60) Provisional application No. 61/867,359, filed on Aug. 19, 2013.

(51) Int. Cl.
*H04R 25/00* (2006.01)

(52) U.S. Cl.
CPC ..... *H04R 25/50* (2013.01); *H04R 2460/05* (2013.01)

(58) Field of Classification Search
CPC .. H04R 25/50; H04R 2460/05; H04R 2460/11
USPC ..... 381/320, 71.6, 312, 322, 328
See application file for complete search history.

(56) References Cited

U.S. PATENT DOCUMENTS

| | | | |
|---|---|---|---|
| 8,111,853 | B2 | 2/2012 | Isvan |
| 8,180,067 | B2 | 5/2012 | Soulodre |
| 8,238,567 | B2 | 8/2012 | Burge |
| 8,401,200 | B2 | 3/2013 | Tiscareno |
| 8,498,428 | B2 | 7/2013 | Schreuder |
| 8,503,689 | B2 | 8/2013 | Schreuder |
| 8,620,650 | B2 | 12/2013 | Walters |
| 8,655,003 | B2 | 2/2014 | Duisters |
| 8,837,746 | B2 | 9/2014 | Burnett |
| 8,942,976 | B2 | 1/2015 | Li |
| 8,983,083 | B2 | 3/2015 | Tiscareno |
| 9,025,415 | B2 | 5/2015 | Derkx |
| 9,100,756 | B2 | 8/2015 | Dusan |

(Continued)

FOREIGN PATENT DOCUMENTS

| | | |
|---|---|---|
| JP | 2010011444 A | 1/2010 |
| TW | 200503572 | 2/1993 |
| TW | 200920159 | 5/2009 |

OTHER PUBLICATIONS

International Search Report and Written Opinion for PCT/US2014/050694 mailed Nov. 26, 2014 (9 pages).

(Continued)

*Primary Examiner* — Harry S Hong

(74) *Attorney, Agent, or Firm* — Foley & Lardner LLP

(57) ABSTRACT

A hearing instrument includes a first speaker having a first frequency range. The hearing instrument also includes a second speaker that is disposed in the ear of a listener. The second speaker has a second frequency range that is wider than the first frequency range. A microphone unit is coupled to the first speaker and the second speaker. The first speaker creates replacement sounds within the first frequency range that replicate sounds that are lost to the listener as a result of an occlusion effect at the second speaker. The replacement sounds are presented to the listener.

17 Claims, 2 Drawing Sheets

(56) References Cited

U.S. PATENT DOCUMENTS

| | | | | |
|---|---|---|---|---|
| 9,154,868 | B2 | 10/2015 | Narayan | |
| 2006/0159298 | A1* | 7/2006 | von Dombrowski .. | H04R 25/48 381/330 |
| 2007/0291971 | A1* | 12/2007 | Halteren ..... | H04R 25/48 381/322 |
| 2008/0123866 | A1 | 5/2008 | Rule | |
| 2009/0052698 | A1 | 2/2009 | Rader et al. | |
| 2009/0052702 | A1 | 2/2009 | Murphy et al. | |
| 2010/0081487 | A1 | 4/2010 | Chen | |
| 2010/0312040 | A1 | 12/2010 | Puria | |
| 2011/0152602 | A1* | 6/2011 | Perkins et al. ..... | 600/25 |
| 2012/0197638 | A1 | 8/2012 | Li | |
| 2013/0024194 | A1 | 1/2013 | Zhao | |
| 2013/0287219 | A1 | 10/2013 | Hendrix | |
| 2014/0044275 | A1 | 2/2014 | Goldstein | |
| 2014/0086425 | A1 | 3/2014 | Jensen | |
| 2014/0169579 | A1 | 6/2014 | Azmi | |
| 2014/0273851 | A1 | 9/2014 | Donaldson | |
| 2015/0010182 | A1* | 1/2015 | Barthel ..... | H04R 25/43 381/320 |
| 2015/0161981 | A1 | 6/2015 | Kwatra | |
| 2015/0245129 | A1 | 8/2015 | Dusan | |

OTHER PUBLICATIONS

Official Letter issued by the Intellectual Property Office of Taiwan for Taiwan Patent Application No. 103127856 dated May 5, 2016 (7 pages).

* cited by examiner

DYNAMIC DRIVER IN HEARING INSTRUMENT

CROSS REFERENCE TO RELATED APPLICATION

This patent claims benefit under 35 U.S.C. §119 (e) to U.S. Provisional Application No. 61/867,359 entitled "Dynamic Driver in Hearing Instrument" filed Aug. 19, 2013, the content of which is incorporated herein by reference in its entirety.

TECHNICAL FIELD

This disclosure relates to speakers, and, more specifically to speakers used in hearing instrument systems.

BACKGROUND

Hearing instruments are in common use today and usually include a microphone circuit, amplification circuit, and receiver (or speaker) circuit. The microphone circuit receives audio energy and then converts this audio energy into electrical signals. The electrical signals may, in turn, be amplified (or otherwise processed) by the amplification circuit and forwarded to the receiver. The receiver circuit may then convert the amplified signals into audio signals that the user of the hearing instrument can hear. Other electronic devices may also utilize the above-mentioned circuits. Receivers and speakers are useful in many listening devices such as earphones, headphones, Bluetooth wireless headsets, or the like.

Generally speaking, conventional receiver in canal (RIC) devices are designed to isolate the desired sound presented at the user's ear drum from other sounds and/or noise from the outside environment above a particular frequency (e.g., approximately 1 kHz). In this regard, previous insert earphones typically included a housing having a receiver mounted within the housing. A rigid ear tip surrounded the housing and engaged the walls of the ear canal. In these systems, the receiver was positioned near the entrance to the ear canal so that the user could receive the sound energy produced by the receiver.

Currently, hearing instrument users are attempting to extend the bandwidth of their instruments to improve the sound quality experienced by the end user. Unfortunately, several problems existed with the current approaches. Customers are expanding the frequency range in both low and high frequencies. A high frequency driver typically does not have sufficient output in low frequencies when in open fit applications. For low frequency operations, a seal is used for a balanced armature receiver to provide sufficient output to the user. However, when the ear is sealed, the user experiences poor sound quality due to occlusion. This has produced user dissatisfaction with these previous approaches.

BRIEF DESCRIPTION OF THE DRAWINGS

For a more complete understanding of the disclosure, reference should be made to the following detailed description and accompanying drawings wherein.

Those of ordinary skill in the art will appreciate that elements in the figures are illustrated for simplicity and clarity. It will be further appreciated that certain actions and/or steps may be described or depicted in a particular order of occurrence while those of ordinary skill in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

A system is provided whereby the occlusion that occurs in previous systems is compensated for and low frequency sounds that have been occluded are effectively replaced by a speaker. In other words, sounds that have been lost are reproduced and presented to the listener. Consequently, the negative effects associated with occlusion are greatly reduced or eliminated. Moreover, the approaches described herein are easy to use, cost effective to implement, and improve the quality of sound presented to the user.

In many of these embodiments, a system includes a microphone unit, a first speaker that has a first frequency range and a second speaker that has a second frequency range. The first speaker and the second speaker are coupled to the microphone unit. The second speaker, in one example, is disposed within an ear tip apparatus and the tip together with the second speaker are placed in the ear (e.g., in the ear canal) of the user. The ear tip apparatus has at least one channel passing there through. The first speaker replaces the sounds that are rolled off (i.e., caused to be lost) as a result of the open fit and the occlusion associated with the open fit. The first speaker is placed, for example, in the outer area of the ear. The sounds produced by the first speaker pass through the channels of the ear tip so that these sounds can be heard by the user.

In other aspects, a RIC device is coupled with a second dynamic driver which remains within the outer ear, to provide the low frequency energy to the ear drum (i.e., <approximately 1 kHz). This dynamic driver will not be sealed to the ear, thereby still giving relief from the occlusion effect. This dynamic driver may only be used in particular situations when there is a desire to provide amplified low frequency sound energy.

Figure 1:
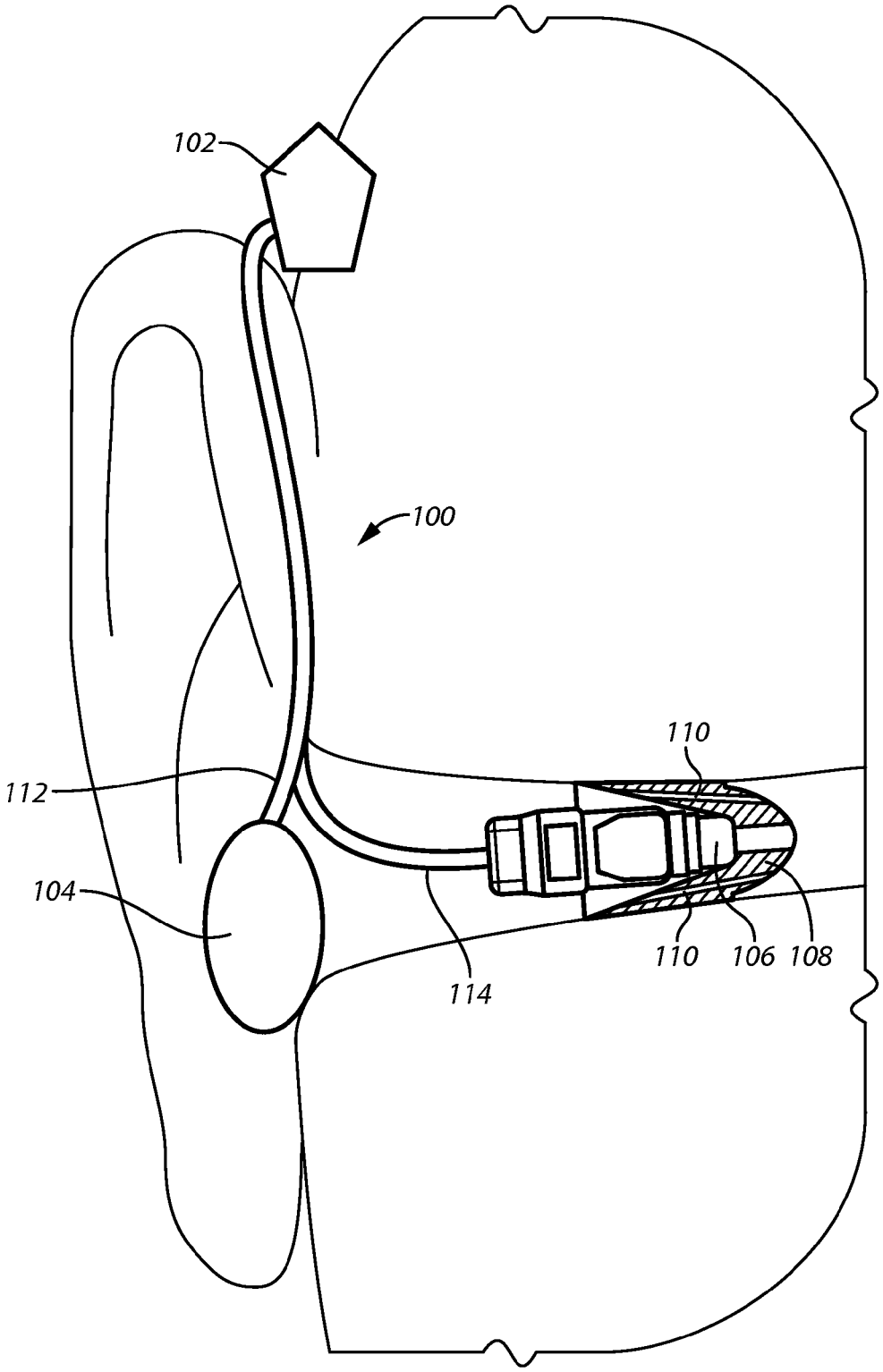
FIG. 1 is a block diagram of an acoustic system that negates the effects of occlusion.

Referring now to FIG. 1, one example of a hearing instrument system that is configured to compensate for occlusion is described. The system 100 includes a microphone unit 102, a first speaker 104 (having a first frequency range) and a second speaker 106 (having a second frequency range). In one example, the first frequency range is 50-1.5 kHz and the second frequency range is 1.5 kHz-12 kHz. The first speaker and the second speaker are coupled to the microphone unit 102. Wires 112 provide a coupling between the microphone unit 102 and the first speaker 104. Wires 114 provide a coupling between the microphone unit 102 and the second speaker 106.

The microphone unit 102 is any microphone unit that receives sound energy and converts the sound energy into electrical signals. In this respect, a Microelectromechanical System (MEMS) microphone such as the MQM manufactured by Knowles Electronics, Inc. may be included in the microphone unit 102. As such, the MEMS microphone within the microphone unit 102 may include a diaphragm, a back plate, and a MEMS die, and operate as known to those skilled in the art. As shown, the microphone unit is a behind-the-ear (BTE) unit, but in other examples may be located at other places such as in-the-ear (ITE) or remote mic, in the outer ear.

The microphone unit 102 may also include and amplifier or other processing circuitry that processes the electrical signals created. Other examples of microphone units, microphones, and functions performed by the microphone unit are possible.

The first speaker 104 is disposed outside the tip 108 in the outer ear of the user. The second speaker 106 is disposed within the tip 108. The tip 108 is a compliant component for example, and includes channels 110 that pass through it. The ear tip 108 is configured to fit within the ear canal of a listener either partially or entirely. The speakers 104 and 106 convert the electrical signals into sound energy so that the user can hear the sound energy. In one example, the speaker 106 is a balanced armature speaker and the speaker 104 is a dynamic driver. The speaker 104 (that is located in the outer ear) is configured to produce sound energy in a predetermined frequency range such as 50 Hz~1.5 kHz. In this respect, the speaker 104 may be a woofer as known to those skilled in the art.

In operation, the first speaker 104 produces and ultimately replaces the sounds that are rolled off (or caused to be lost) as a result of the open fit of the ear tip 108. The lost sounds may be of a predetermined frequency range. The first speaker 104 is placed, for example, in the outer area of the ear. By outer area of the ear, it is meant a region including but not restricted to the concha. The sounds produced by the first speaker pass through the channels 110 of the ear tip 108 so that these sounds can be heard by the user. The channels 110 may be one or more holes, openings, or passageways having a predetermined diameter that extend completely through the ear tip 108 and thereby allow sounds to pass from the first speaker 104 to the ear canal of the listener so that these sounds can be heard by the listener.

Figure 2:
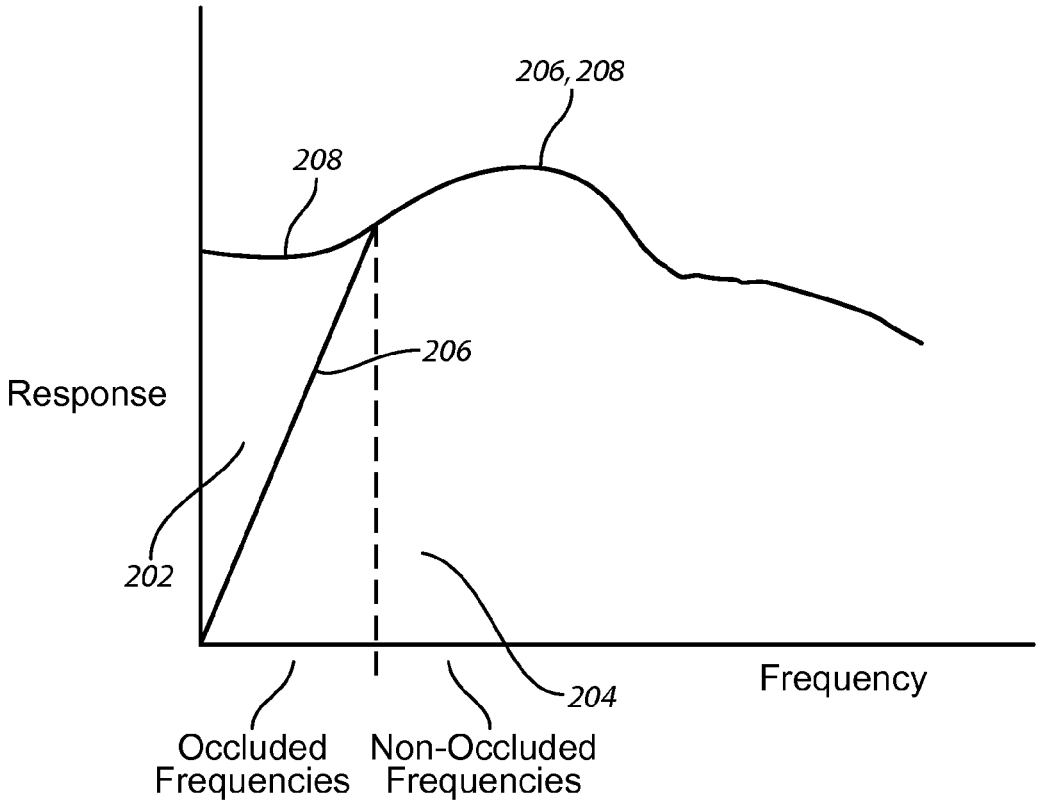
FIG. 2 is a graph of a system response showing the effects of implementing the approaches described herein.

Referring now to FIG. 2, one example of the beneficial effects of the approaches described herein is described. As shown in FIG. 2, a first region 202 includes frequencies (indicated by the horizontal axis) that are lost due to occlusion and prevented by the effect from reaching the user. A second region 204, on the other hand includes frequencies that are not lost due to occlusion and, consequently, reach the user. Occlusion produces a response curve 206 as shown in FIG. 2.

However, the present approaches reintroduce frequencies in the first region 202 (that are lost when addressing occlusion due to open fit applications) by using a speaker (e.g., the speaker 104) that resides in the outer ear. Sounds of a predetermined frequency range are produced, pass through one or more openings in the ear tip, and reach the user. The effect of doing this makes yields the response 208. In this way, the negative effects of occlusion are negated or eliminated and the response of the system (the response heard by a listener) does not include missing frequencies.

Preferred embodiments of this disclosure are described herein, including the best mode known to the inventor(s). It should be understood that the illustrated embodiments are exemplary only, and should not be taken as limiting the scope of the appended claims.

What is claimed is:

1. A hearing instrument, the hearing instrument comprising:

a first electro-acoustic transducer;

a second electro-acoustic transducer having an acoustic output;

an ear tip having a first sound channel terminating at an orifice on a first end portion of the ear tip, the second electro-acoustic transducer disposed at least partially in the ear tip and the acoustic output of the second electro-acoustic transducer acoustically coupled to the first sound channel, the ear tip having a second sound channel that allows sound produced by the first electro-acoustic transducer to pass through the ear tip, the second sound channel compensating for occlusion that occurs when the ear tip is in use;

wherein the first electro-acoustic transducer compensates for sounds lost as a result of occlusion compensation.

2. The hearing instrument of claim 1, wherein the sounds produced by the first electro-acoustic transducer have frequencies less than 1 kHz.

3. The hearing instrument of claim 1, wherein the second sound channel extends through the ear tip from a second end portion of the ear tip to the first end portion thereof, the first electro-acoustic transducer is positioned adjacent to and apart from the second end portion of the ear tip.

4. The hearing instrument of claim 1, further comprising a microphone unit coupled to the first electro-acoustic transducer and the second electro-acoustic transducer.

5. The hearing instrument of claim 4, wherein the microphone unit comprises a microelectromechanical system (MEMS) microphone.

6. The hearing instrument of claim 4, wherein the microphone unit is a behind-the-ear (BTE) unit.

7. The hearing instrument of claim 4, wherein the microphone unit is an in-the-ear (ITE) unit.

8. The hearing instrument of claim 1, wherein the second sound channel comprises a plurality of channels.

9. The hearing instrument of claim 1, wherein the first electro-acoustic transducer comprises a woofer.

10. A hearing instrument comprising:

a first electro-acoustic transducer;

an ear tip having a first sound channel with a port at an inner end portion of the ear tip, at least a portion of the ear tip sized to fit in a user's ear canal;

a second electro-acoustic transducer, the second electro-acoustic transducer disposed at least partially in the ear tip in communication with the first sound channel;

the ear tip including a second sound channel extending through the ear tip from an outer end portion of the ear tip to the inner end portion thereof, the outer end portion opposite the inner end portion, the first electro-acoustic transducer disposed proximate the outer end portion of the ear tip;

an unsealed acoustic coupling between the first electro-acoustic transducer and the second sound channel;

whereby sound from the first electro-acoustic transducer passes through the second sound channel from the outer end portion of the ear tip to the inner end portion of the ear tip.

11. The hearing instrument of claim 10 further comprising a microphone, the first electro-acoustic transducer and the second electro-acoustic transducer both coupled to the microphone.

12. The hearing instrument of claim 10, wherein frequencies from the first electro-acoustic transducer that pass through the second sound channel are lower than frequencies from the second electro-acoustic transducer that pass through the first sound channel when the inner end portion of the ear tip is disposed in the user's ear canal.

13. The hearing instrument of claim 12, wherein the second electro-acoustic transducer is disposed at least partially within the ear tip on a side of the ear tip opposite the inner end portion thereof, a sealed coupling between the second electro-acoustic transducer and the first sound channel, at least a portion of the ear tip sized to contact a user's ear canal when the inner end portion of the ear tip is disposed in the user's ear canal.

14. The hearing instrument of claim 10, wherein the second electro-acoustic transducer is disposed at least partially within the ear tip on a side of the ear tip opposite the inner end portion thereof, and a sealed coupling between the second electro-acoustic transducer and the first sound channel.

15. The hearing instrument of claim 14, wherein a first frequency range that passes through the second sound channel from the first electro-acoustic transducer includes frequencies that are lower than frequencies that pass through the first sound channel from the second electro-acoustic transducer when the inner end portion of the ear tip is disposed in the user's ear canal.

16. The hearing instrument of claim 15 further comprising a microphone, the first electro-acoustic transducer and the second electro-acoustic transducer both coupled to the microphone.

17. The hearing instrument of claim 16, the microphone is a micro-electromechanical systems microphone.

* * * * *